United States Patent [19]

Caldwell

[11] 3,968,928

[45] July 13, 1976

[54] MAIL BOX ROTATABLE SIGNAL

[76] Inventor: Victor L. Caldwell, R.D. No. 1, Medina, N.Y. 14103

[22] Filed: Mar. 21, 1975

[21] Appl. No.: 560,621

[52] U.S. Cl. ..... 232/35; 116/134; 232/37

[51] Int. Cl.[2] ..... B65D 91/00

[58] Field of Search ..... 116/134, 135; 232/37, 232/35, 34, 1 C

[56] References Cited

UNITED STATES PATENTS

| | | | |
|---|---|---|---|
| 1,564,305 | 12/1925 | Fanders | 232/35 |
| 2,475,098 | 7/1949 | Jones | 232/35 |

*Primary Examiner*—Jerry W. Myracle
*Assistant Examiner*—Daniel Yasich
*Attorney, Agent, or Firm*—Ashlan F. Harlan, Jr.

[57] ABSTRACT

A signal for a rural mail box which is automatically moved from one signalling position to another when the door of the mail box is opened, thus indicating to an observer located at a distance that the box has been opened and that mail has been deposited therein. The mechanism for operating the signal includes a pull rod attached to the door of the mail box and having a lost motion connection with a spindle carrying the signal.

7 Claims, 5 Drawing Figures

Fig. 1.
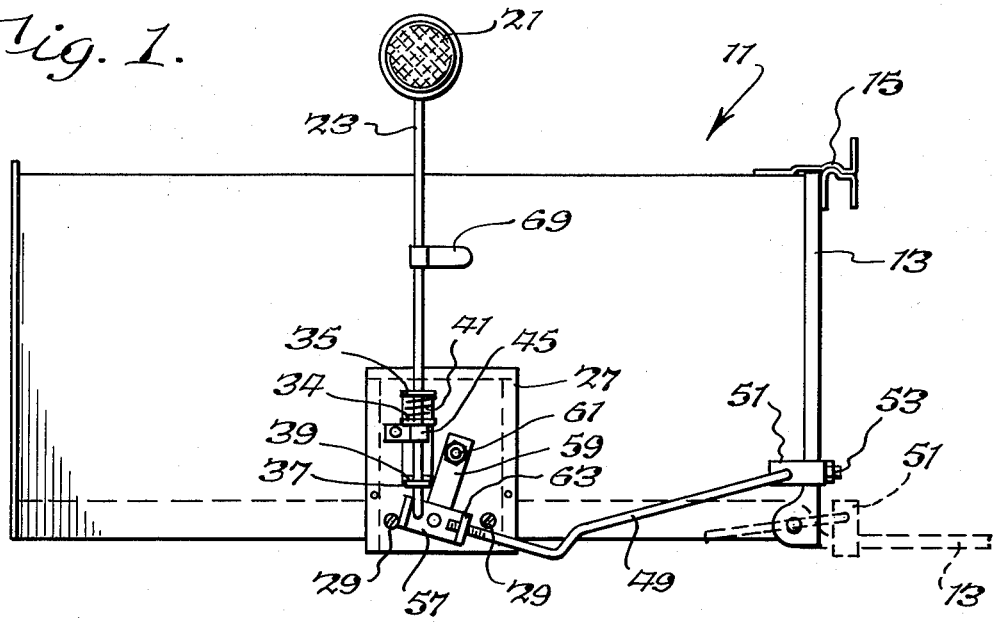
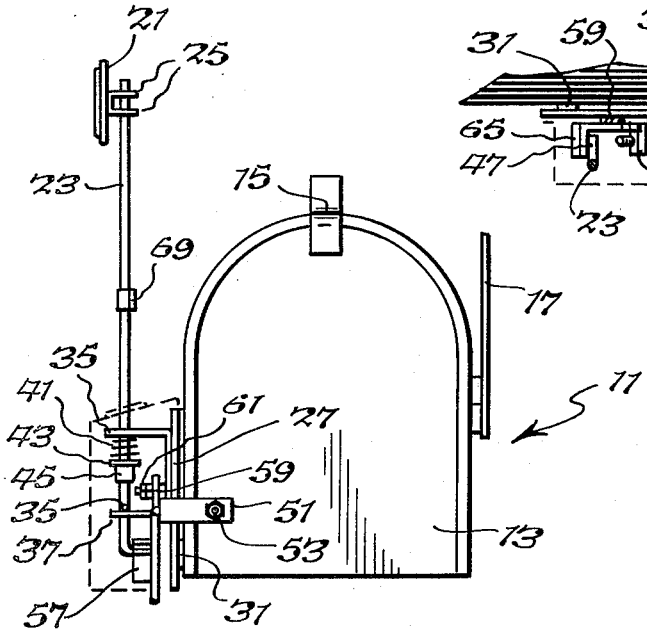
Fig. 2.
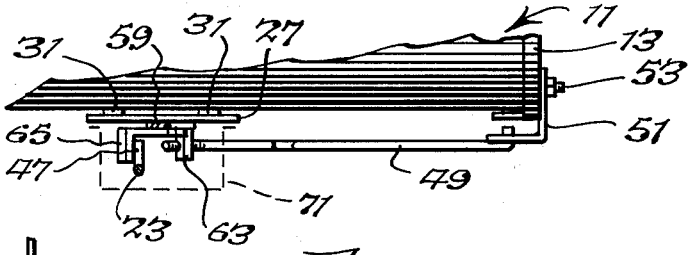
Fig. 3.
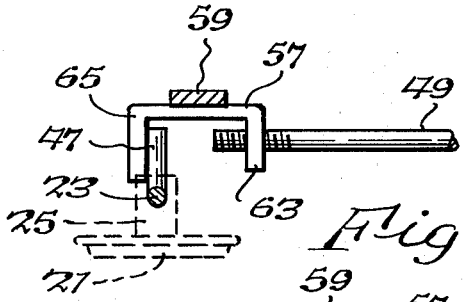
Fig. 4.
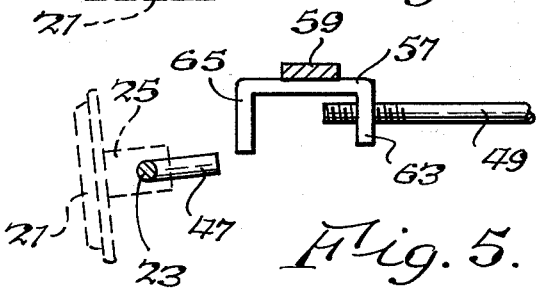
Fig. 5.

MAIL BOX ROTATABLE SIGNAL

BACKGROUND OF THE INVENTION

This invention relates to mail boxes and is particularly concerned with a signal for a rural mail box which will indicate that the box has been opened.

Rural mail boxes are often located at a considerable distance from the house of the mail patron. Unless time is wasted keeping a vigilant watch on the highway and the mail box, there is ordinarily no way of telling whether mail has been deposited in the box by the mail carrier. On many days, therefore, a number of useless trips may be made to the mail box to ascertain whether mail has been left therein. The invention of the present application provides means whereby, when the mail box is opened so that mail may be deposited therein, a signaling device is operated that makes it possible to tell from a distance that the box has been opened. Thus, it is unnecessary to keep watch over the mail box or to make repeated inspections thereof in order to determine whether mail has been deposited therein.

SUMMARY OF THE INVENTION

The signalling device of the present invention comprises an adjustable signal and means, operated by the opening of the door of the mail box, for moving said signal to a predetermined position. Said means includes a pull rod pivotally attached to the door of the mail box, whereby said rod will be activated when the door is opened or closed, and a lost motion connection between said rod and a horizontally bent portion of a vertical spindle carrying a signal, whereby said spindle is turned when said door is opened, but is not thereafter moved by subsequent movement of said door. Means is also provided for resetting the signal.

SHORT DESCRIPTION OF THE DRAWINGS

FIG. 1 is a side elevational view of a mail box provided with a signal according to the invention;

FIG. 2 is a front elevational view of the mail box illustrated in FIG. 1;

FIG. 3 is a fragmentary plan view of the mail box illustrated in FIGS. 1 and 2, showing the signal operating mechanism; and FIGS. 4 and 5 are enlarged views showing details of the way in which the signal is turned by opening the mail box door.

THE INVENTION

As illustrated in FIGS. 1 and 2, the signalling device may be attached to a conventional rural mail box 11. The box 11 is provided with a conventional front door 13, hinged at the bottom, and having a spring clip or detent 15 at its top for releasably holding the door closed. If desired, a conventional, horizontally pivoted flag 17 may be provided on the box 11 to indicate to the mail carrier that the box contains mail for collection.

The terms "upper", "lower", "top", "bottom", "right", "left", "above", "below", "vertical", and "horizontal", and similar terms of position and/or direction as used hereinafter, refer to the illustration in FIGS. 1 and 2, but are used only for convenience in description and/or reference. Such terms should not be so construed as to imply a necessary positioning of the structure or portions thereof or to limit the scope of this invention.

The signal employed in accordance with the present invention to indicate the presence of mail in the mail box 11 is preferably a reflector button 21 which may be of any desired and suitable size, shape, and color. The button 21 is releasably and adjustably held on a mounting spindle 23 by a pair of laterally extending, perforated spring fingers 25 that encircle and grip the spindle. The spindle 23 is rotatably mounted, preferably in a vertical position, on a mounting plate 27 that is secured on the side of the mail box 11 by screws 29. The latter carry washers 31 between the plate 27 and the box 11 to space the plate from the box.

The spindle 23 is rotatably supported and journalled in vertically aligned holes in a pair of vertically spaced brackets 35, 37 that project from the mounting plate 27 to which they are suitably attached. A pin 39 passing through the spindle 23 rests on the bracket 37, thus supporting the spindle, and a compression spring 41 encircles the spindle and bears, at its ends, against the upper bracket 35 and a washer 43 on the spindle 23 that rests on a collar 45 on the spindle. Thus, the pin 39 is firmly held against the lower bracket 37. The lower end of the spindle 23 is bent substantially horizontally, as shown at 47 and normally projects inwardly toward the mail box 11.

The signal actuating means comprises a pull rod 49 which is pivotally connected at one end to a bracket 51. The latter is attached to the door 13 of the mail box 11 by a bolt 53. The pull rod 49 is threadedly connected at its other end to a yoke 57. The yoke 57 is carried on a mounting arm 59 that is pivotally mounted on the mounting plate 27 by a bolt 61. The yoke 57 comprises two outwardly projecting ears or lugs 63 and 65. The inner end of the pull rod 49 is threadedly engaged in the former, whereby when the rod 49 is pulled to the right as the mail box door 13 is opened, as shown in broken lines in FIG. 1, the yoke 57 will also be pulled to the right. As most clearly shown in FIGS. 4 and 5, the signal spindle 23 is thereby caused to rotate because of engagement of the lug 65 with the bent end 47 of the spindle.

It will be evident from the foregoing description that the signal described is convenient and easy to use and is effective for the desired purpose. In normal use, after mail has been removed from the box 11, the box door 13 is closed and the signal spindle 23 is turned, conveniently by the handle 69 attached thereto, whereby the bent lower end 47 thereof points toward the box 11, as shown in FIG. 4, between the lugs 63 and 65. Subsequently, when the box door 13 is opened to place mail in the box, the pull rod 49 is moved to the right, as shown by broken lines in FIG. 1, and the yoke 57 attached thereto is moved by the rod 49 to turn the spindle 23, as shown in detail in FIG. 5, by engagement of the lug 65 with the bent end 47 of the spindle, thus turning the signal button 21 clockwise. Upon closing the door, however, the bent end 47 of spindle 23 is in a position where it is not engaged by the yoke 57 and the signal button 21 is not, therefore, again moved. To achieve maximum visibility, the signal button 21 is adjustably mounted on the spindle 23 so that it can be vertically and angularly adjusted to reflect a maximum of light to a watcher at a window or door in a house or other building from which the signal may be visible. Pressure of the spring 41 causes the pin 39 to have frictional engagement with the bracket 37. Thus, the signal spindle is held firmly in adjusted position. If desired, grooves (not shown) may be provided in the bracket 37 for engagement by the pin 39 so that the signal is further restrained in adjusted position. It may be noted that the signal buttons 21 may be of different colors, shapes and sizes and that if desired more than one such button can be used on a single spindle. The variation in display thus made possible is of value where a plurality of mail boxes equipped with signals are located in close proximity, since the several boxes may be individually identified.

It will be understood that the signalling device of the present invention may be built into a mail box, or may be provided as a kit which can be easily attached to a mail box. The materials employed for the signalling device are not particularly critical. Preferably, the spindle 23 and pull rod 49 are formed of suitable metal. The mounting plate 27 and the yoke and mounting arm 57, 59 may be formed of metal or a suitable plastic material as may also the cover 71 which may be suitably mounted on the plate 27 to provide protection for the mechanism carried thereon against adverse weather conditions. It will be evident that by adjusting the position of the threaded end of the rod 49 in the lug 63 and the angular position of the reflector button 21 on the spindle 23 the button 21 may be used to signal in any direction.

I claim:

1. A signalling device for a rural mail box having a door comprising: a signal adjustably mounted on a vertical spindle for rotation with said spindle, said spindle having its lower end bent to project substantially horizontally; a pull rod detachably and pivotally connected at one end to said door and adapted to be moved in generally horizontal, opposite directions as said door is opened or closed; said spindle and said pull rod being operatively connected by a pivotally mounted yoke, said yoke having a lug thereon adapted to engage said bent lower end of said spindle whereby to turn said spindle only when said lug is moved in one direction by opening of said door but not engaging said spindle when said lug is moved in the other direction by subsequently closing said door, said yoke having an adjustable connection with the other end of said pull rod whereby to vary the movement of said yoke.

2. A signalling device as defined in claim 1 wherein said yoke comprises a second lug substantially parallel to said first-mentioned lug and said pull rod is threadedly engaged in said second lug.

3. A signaling device as defined in claim 2 wherein said spindle is provided with means for releasably holding it in adjusted position.

4. A signaling device as defined in claim 2 wherein the lower portion of said spindle and said yoke are provided with a cover.

5. A signaling device as defined in claim 1 wherein said spindle is provided with means for releasably holding it in adjusted position.

6. A signaling device as defined in claim 5 wherein the lower portion of said spindle and said yoke are provided with a cover.

7. A signaling device as defined in claim 1 wherein the lower portion of said spindle and said yoke are provided with a cover.

* * * * *